US005100143A

United States Patent [19]

Puckett

[11] Patent Number: 5,100,143

[45] Date of Patent: Mar. 31, 1992

[54] BROADHEAD HUNTING ARROW

[75] Inventor: Riley Puckett, Lorton, Va.

[73] Assignee: Pucketts Bloodtrailer Broadhead, Lorton, Va.

[21] Appl. No.: 631,646

[22] Filed: Dec. 21, 1990

Related U.S. Application Data

[63] Continuation of Ser. No. 460,299, Jan. 3, 1990, Pat. No. 4,998,738.

[51] Int. Cl.[5] ..... F42B 6/08

[52] U.S. Cl. ..... 273/421

[58] Field of Search ..... 273/416, 419, 421, 422

[56] References Cited

U.S. PATENT DOCUMENTS 2,859,970 11/1958 Doonan ..... 273/421
4,504,063 3/1985 LeBus ..... 273/422
4,579,348 4/1986 Jones ..... 273/421
4,932,671 6/1990 Anderson ..... 273/421
4,976,443 12/1990 DeLucia ..... 273/421

*Primary Examiner*—Edward M. Coven
*Assistant Examiner*—William E. Stoll
*Attorney, Agent, or Firm*—Whitham & Marhoefer

[57] ABSTRACT

A broadhead (10) includes a pair of upper blades (24) and a pair of lower blades (26) which are held within slots (20 and 22, respectively) in a cylindrical body (14) while the arrow is in flight. Upon impact with an animal, a plunger tip (12) slides into the cylindrical body (14) and the upper and lower blades (24 and 26, respectively) are forced to their open position by acting against the cam surfaces (38 and 44) positioned within the cylindrical body (14). A C-shaped ring (48) performs the functions of holding the plunger tip (12) in its extended position in flight and locking the blades (24 and 26) in their open position upon impact.

5 Claims, 4 Drawing Sheets

BROADHEAD HUNTING ARROW

This patent application is a continuation of Ser. No. 460,299 filed Jan. 3, 1990, now U.S. Pat. No. 4,998,738, and that patent is herein incorporated by reference.

BACKGROUND OF THE INVENTION

1. Field of the Invention

The subject invention is directed to a broadhead hunting arrow wherein the cutting blades are in a fully retracted position within a cylindrical body during the flight of the arrow. Upon striking the quarry, the cutting blades are opened and locked in an extended position.

2. Description of the Prior Art

Broadhead hunting arrows have been used for many years for hunting game animals such as deer. A broadhead is a particular type of arrow head which has outwardly extending blades that are designed to inflict more extensive damage to the animal. An objective for any broadhead is to have the animal killed as quick as possible such that the animal will not suffer for a long period of time and so that the animal will be recoverable by the hunter. Hunting regulations require broadheads to be of a specific size that will ensure killing the animal quickly such that the hunter does recover his quarry and will report the kill to the game warden. Broadheads having smaller than the legal width generally do not inflict as much damage and result in slower bleeding. The illegal broadheads do not kill the animal as fast, yet they do mortally wound the animal; hence, the hunter using the illegal broadhead typically loses his prey and does not report the kill. Accurate harvesting records which reflect all kills ensure better wildlife management.

Today's hunting arrows typically comprise a fiberglass or graphite shaft on which the broadhead body is threadably mounted. In many prior art broadheads, the blades are secured on the arrow in a fully open position, i.e., they are clipped to the sides or integrally formed with the body that is secured to the arrow shaft. It has been found that the flight of the arrow is adversely affected by wind resistance acting against the exposed broadhead blades. For example, broadheads with fixed blades tend to be less accurate because of wind current deflection and tend to have less velocity because of increased drag. Therefore, design efforts for modern broadheads typically have focussed on decreasing the wind effects to ensure a more accurate and effective broadhead.

U.S. Pat. No. 4,504,063 to LeBus discloses a broadhead hunting arrow which is designed to have the blades positioned in a narrower profile during flight and to have the blades moved to an expanded position when the arrow strikes the animal. A plunger tip positioned at the front of the broadhead moves towards the blades upon impact and causes a mass connected at the opposite end of the plunger to move within the hollow body and act against an inside surface of each of the blades. The inside surface of the blades is shaped such that the mass forces the blades outward when the plunger is forced rearward. One problem with the LeBus broadhead is that it is designed to always have some portion of the blades exposed; therefore, the effects of wind resistance are not completely avoided. Another problem with the LeBus broadhead is that there is no provision for preventing the main stem from riding up on the plunger and causing the blades to open during flight. Today's bows typically launch an arrow at a rate of 250 feet per second (fps) which may be a speed sufficient to cause the blades to open simply by the dead weight inertia of the mass within the hollow body relative to the quickly moving shaft.

U.S. Pat. No. 2,859,970 to Doonan discloses an arrow head designed to have cutting blades retracted within a cone at the front of the arrow during flight, yet have the cutting blades open upon impact with the animal. Doonan discloses that having fully retracted blades during flight avoids the adverse wind effects such as deflection of the arrow in an undesired direction and decreased flight velocity; however, problems with the Doonan arrow head would make it unacceptable for today's bow equipment. Doonan shows a cone shaped unit positioned on the front of an arrow with a target point. The cone can be held on the end of the shaft with a frictional fit or by riding in grooves on the shaft of the arrow. A pair of cutting blades are secured to a pivot pin within the cone body. The cutting blades are bowed slightly such that they will be frictionally held within the slots of the cone body during flight. The target point of the arrow acts as a camming surface against the backside of the retracted blades and forces the blades open when the animal is struck by the arrow.

One problem with the Doonan design is that it relies on the arrow shaft to open the blades. In today's equipment, the broadhead is threadably secured to the arrow shaft, not frictionally fit on the front end of a target arrow; therefore, there is no way for the shaft to provide any camming action against a pair of retracted blades. Moreover, Doonan's frictional fit design may allow a deer to pull the arrow shaft, without the cone shaped tip, out of its body after being struck, thereby closing the wound and decreasing the bleeding. With a modern, threaded together, broadhead hunting arrow, the deer could not pull the shaft out of its body without also pulling out the broadhead.

Another problem with the Doonan design is that the amount of frictional engagement between the slightly bowed cutting blades and the slots in the cone shaped body is not easily regulated and may be insufficient to hold the blades in their retracted position during flight. Moreover, an arrow shot at 250 fps should have sufficient velocity to open the blades fully in flight, i.e., Doonan's arrow head would not work with modern equipment since the target arrow head would be driven into the backside of the blades simply by the speed and force of today's bows.

The Forrestline company is currently selling a broadhead called the Punchcutter TM which is designed with a pair of blades held in a fully retracted position during flight. Upon striking an animal, the blades are opened 90° from the retracted position. The blades are positioned within a cylindrical body on a pivot pin located closer to the arrow shaft than the arrow tip. The Punchcutter TM design has led to very unsatisfactory results. Since the blades open from a backward orientation to a 90° angle, the blades are pushed rather than pulled through the animal. As a result, the broadhead does not penetrate through the animal and causes less extensive damage than desired; hence, a number of deer have been mortally wounded with the Punchcutter TM but have not been retrieved by the hunter.

SUMMARY OF THE INVENTION

It is therefore an object of this invention to provide a broadhead which has retracted blades during flight and open blades upon impact with an animal that overcomes the disadvantages of prior art broadheads with deployable blades.

It is another object of this invention to provide a broadhead which positively holds a plurality of blades in a retracted position during flight and positively locks the blades in an open position after impact with the animal.

According to the invention, a broadhead has been designed with four cutting blades that are retracted within a cylindrical body during flight and are locked open upon impact with an animal. The tip of the broadhead is a plunger which slides within the cylindrical body. The four cutting blades are connected to the plunger via pivot pins. Preferably the four cutting blades are arranged as upper and lower pairs and are positioned at 90° increments around the plunger. Each pair of cutting blades fits within a slot that passes through opposite sides of the cylindrical body and is packed on a pivot pin with a flexed washer between each blade. When the plunger is fully extended (i.e., the in flight position), the blades are held within the slots by the biasing force of the flexed washer. Upon impact with an animal, the plunger is driven towards the rear of the cylindrical body and consequently forces the back side of each blade against camming surfaces formed inside the cylindrical body. At impact, the blades are cammed outward from the slot and are positioned to cause extensive damage to the animal. A C-shaped ring, positioned to ride on the outside surface of the plunger, locks the blades open when it falls into a channel encircling the plunger near the pointed tip. A second, shallower channel may be formed around the plunger just above the position of the first pair of cutting blades to interact with the C-shaped ring while the arrow is in flight and hold the plunger tip in its fully extended position.

BRIEF DESCRIPTION OF THE DRAWINGS

The foregoing and other objects, aspects and advantages of the invention will be better understood from the following detailed description of the preferred embodiments of the invention with reference to the accompanying drawings, in which.

DETAILED DESCRIPTION OF THE PREFERRED EMBODIMENTS OF THE INVENTION

Figure 1:
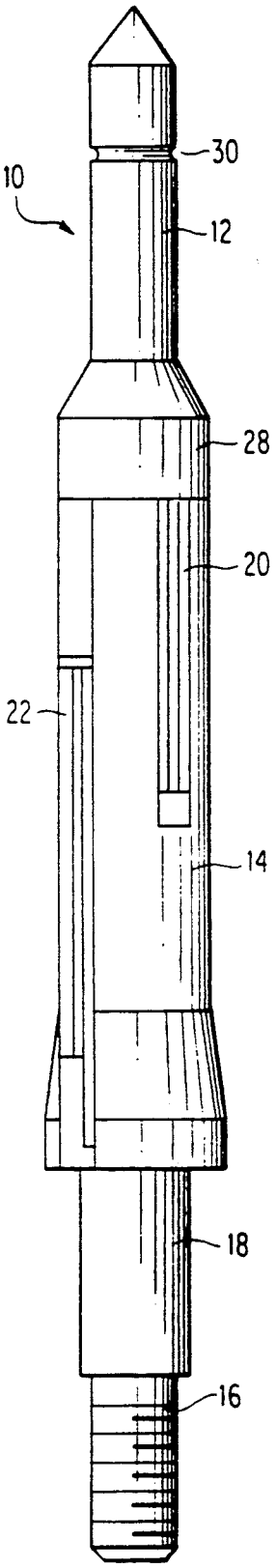
FIG. 1 is an isometric view of a broadhead with fully retracted blades and reflects the "in flight" configuration of the broadhead.
Figure 2:
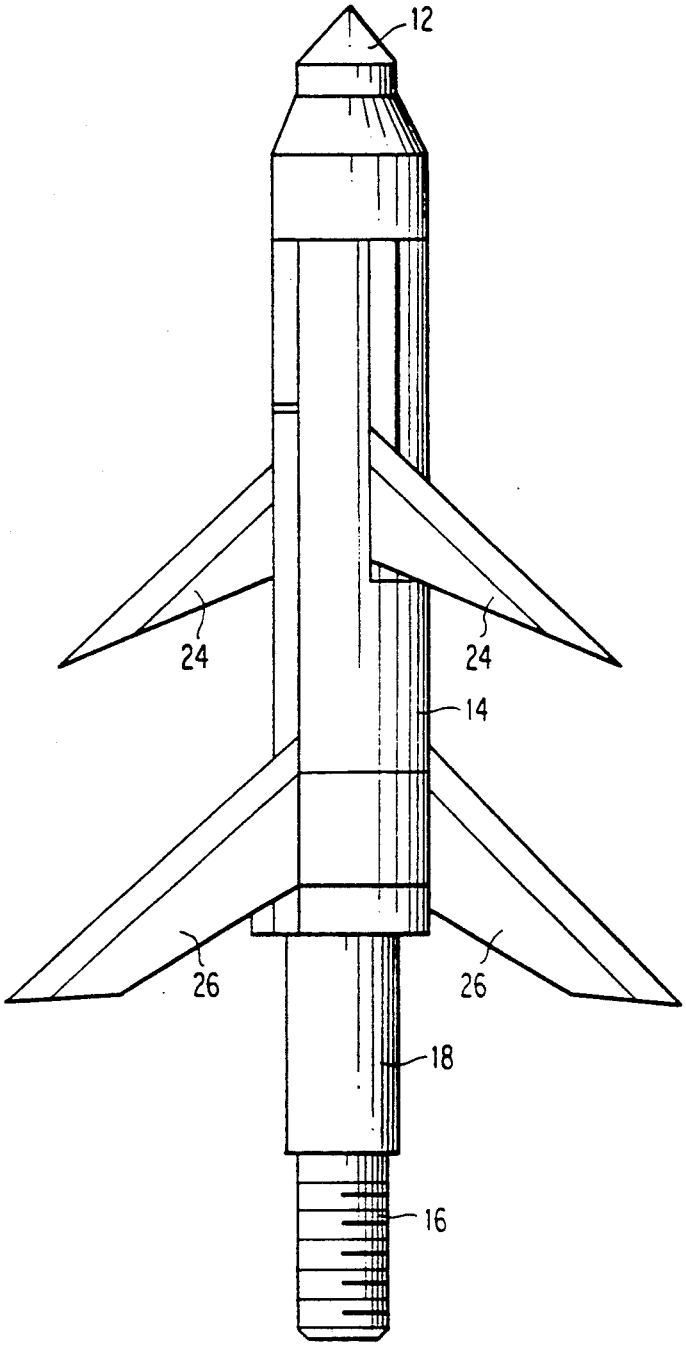
FIG. 2 is an isometric view of the broadhead shown in FIG. 1 with fully opened blades and reflects the "impact" configuration of the broadhead.

Referring now to the drawings, and more particularly to FIGS. 1 and 2, there is shown a broadhead 10 in its "in flight" and "impact" configurations, respectively, having a pointed plunger tip 12, a cylindrical body 14, and a threaded bottom 16. The broadhead 10 is secured to an arrow shaft (not shown) by threaded bottom 16. Shoulder 18 fits within a counterbore in the top of the arrow shaft. The cylindrical body 14 has slots 20 and 22 which house upper and lower pairs of cutting blades 24 and 26, respectively. Preferably, the slots 20 and 22 are positioned such that the blades 24 and 26 extend at each 90° increment around the cylindrical body 14.

In operation, the plunger tip 12 is fully extended as shown in FIG. 1 when the broadhead is in flight. The plunger tip 12 moves towards the cylindrical body 14 and causes the cutting blades 24 and 26 to open to the impact configuration shown in FIG. 2 when an animal is struck by the arrow. A C-shaped ring (not shown), housed within cap 28 locks the blades 24 and 26 in their open configuration when it fits into the channel 30 encircling the plunger tip 12 towards its top section.

Figure 3:
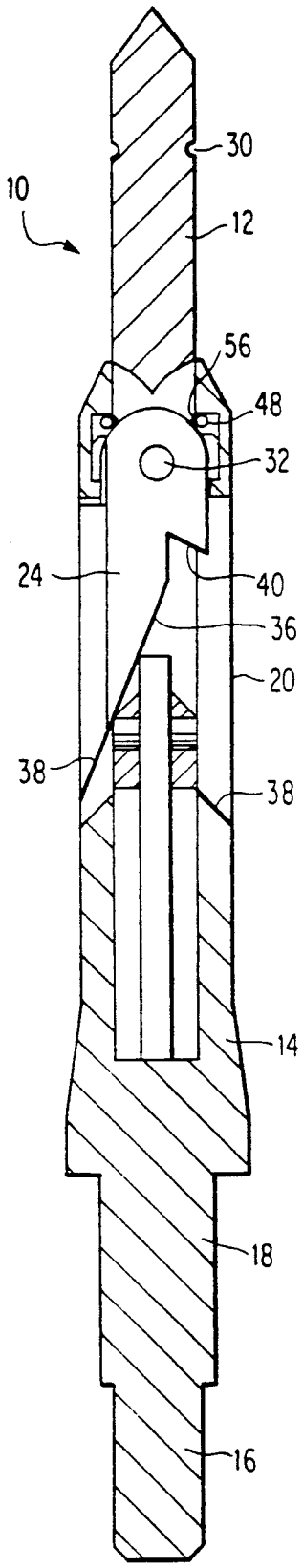
FIG. 3 is a cross-sectional side view of a broadhead in the in flight configuration showing one upper blade in its fully retracted position.
Figure 4:
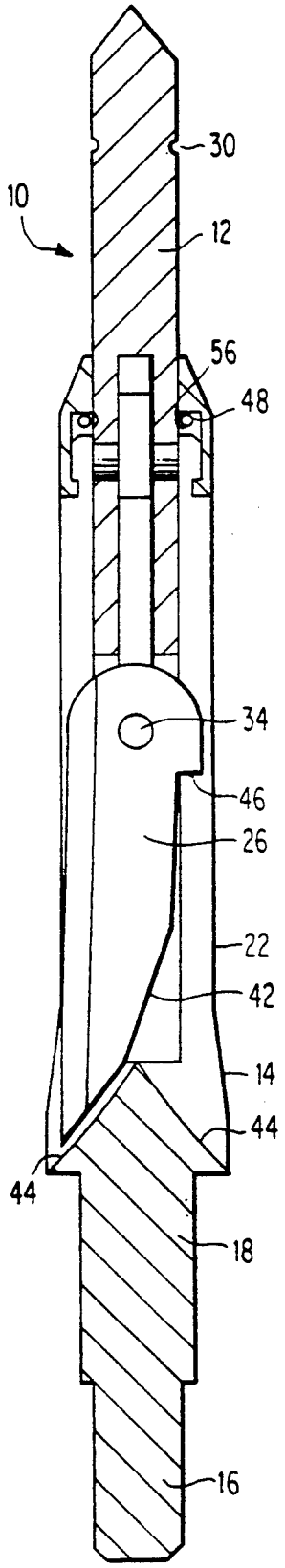
FIG. 4 is a cross-sectional side view of the broadhead shown in FIG. 3 taken 90° therefrom showing one lower blade in its fully retracted position.

Referring now to FIGS. 3 and 4, which show two cross-sectional views taken at 90° increments with respect to one another of a broadhead 10 in its "in flight" configuration, the upper and lower blades, 24 and 26, are connected to the plunger tip 12 by pivot pins 32 and 34, respectively. Only one of each pair of blades, 24 or 26, is shown; the other blade being positioned in the opposite orientation on the pivot pin, 32 or 34. The upper blade 24 has an angled back side 36 which cooperates with an angled cam surface 38 formed in the cylindrical body 14 and a notched section 40 which fits into the space behind cam surface 38. The lower blade 26 has an angled back side 42 which cooperates with an angled cam surface 44 formed in the cylindrical body and a notched section 46 which fits over one side of the angled cam surface.

Figure 9:
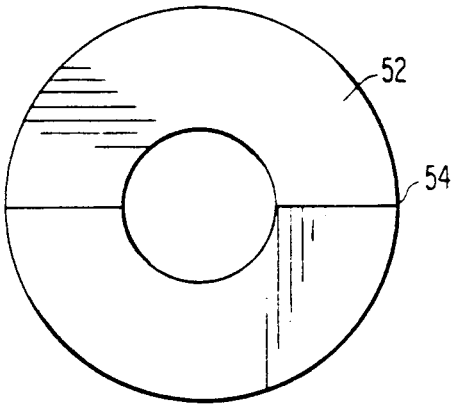
FIG. 9 is a plan view of a washer used for biasing against a pair of blades.
Figure 10:
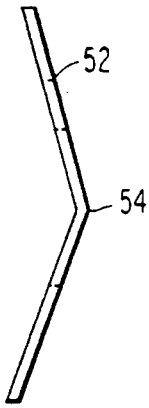
FIG. 10 is a side view of the washer shown in FIG. 9 showing a central flexed section.
Figure 11:
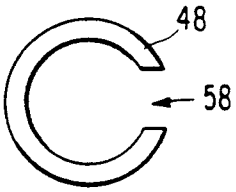
FIG. 11 is a plan view of a C-shaped ring used to lock the plunger in position.
Figure 12:
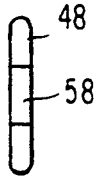
FIG. 12 is a side view of the C-shaped ring shown in FIG. 11.

Referring now to FIGS. 7 through 10 in addition to FIGS. 3 and 4, the upper blades 24 fit within slot 50 in plunger tip 12. The upper blades 24 are packed on the pivot pin 32 (shown in FIG. 7 but absent in FIG. 8) as a blade 24, washer 52, blade 24 sandwich. FIGS. 9 and 10 show the washer 52 is bent in the middle 54 such that it will provide a positive bias against the upper blades 24 that will hold the blades 24 in their retracted position during the flight of the arrow as shown in FIG. 3. In addition, upper blades 24 fit within cap 28 when the plunger tip 12 is fully extended and the cap 28 would also hold the blades 24 in their retracted position during the flight of the arrow. Likewise, lower blades 26 are held in their retracted position within slot 22 of the cylindrical body 14 during the flight of the arrow by the biasing force exerted by a washer 52 sandwiched between the lower blades 26 on pivot pin 34 (shown in FIG. 8 but not FIG. 7). While a bent washer 52 is shown in FIGS. 9 and 10, it is anticipated that lock washers, belleville washers, and other suitable biasing devices could be used to hold the upper and lower blades 24 and 26 in their retracted position. In addition, it is anticipated that blades 24 and 26 could be constructed with outwardly flexed portions that would perform the function of the washer 52.

The bias provided by washer 52 is a positive force that is far more effective than a frictional engagement between a bent blade and a slot as discussed in U.S. Pat. No. 2,859,970 to Doonan. The washer 52 is designed to hold the blades 24 or 26 tightly against the walls of the slots 20 and 22 during the flight of the arrow. Conversely, in Doonan the blades are bowed such that there is frictional drag between the side walls of the slots in the cone member and the bowed blades. The positive bias provided by a washer 52 or equivalent structure is far easier to control than a frictional engagement. Control of the bias force is an important feature because the blades must be held firmly enough within the cylindrical body 14 during the flight so as to avoid adverse wind effects, yet they also must not be held too tightly since the blades must be free to spring open and cause maximum damage to the animal upon impact.

Referring now to FIGS. 3, 4, 7, 8, 11, and 12, the C-shaped ring 48 positioned within the space between the cap 28 and the cylindrical body 14 has a smaller diameter than the plunger tip 12; therefore, the force of the impact must open the C-shaped ring slightly so that it may ride against the plunger tip 12 as it slides into the cylindrical body 14 and then snap into the channel 30 to lock the blades 24 and 26 open. The C-shaped ring 48 holds the plunger tip 14 in its fully extended position shown in FIGS. 3 and 4 by resting within a shallow, rear channel 56. Since the plunger tip 12 is larger in diameter than the C-shaped ring 48, the plunger tip 12 is prevented from moving during flight. An alternative method for holding the plunger tip 12 in its extended position is to have a plunger tip 12 fabricated which increases in diameter towards the front of the plunger tip 12. In the alternative method, the outwardly tapered sidewall of the plunger tip 12 would provide a functionally similar result as the shallow, rear channel 56. Upon impact with the animal, the C-shaped ring 48 is deformed by enlarging at gap area 58 so that it may ride against the outside wall of the plunger tip 12. The C-shaped ring 48 snaps into the front channel 30 to lock the blades 24 and 26 in the "impact" position so that a deer may not pull the broadhead 10 out of its body.

Figure 5:
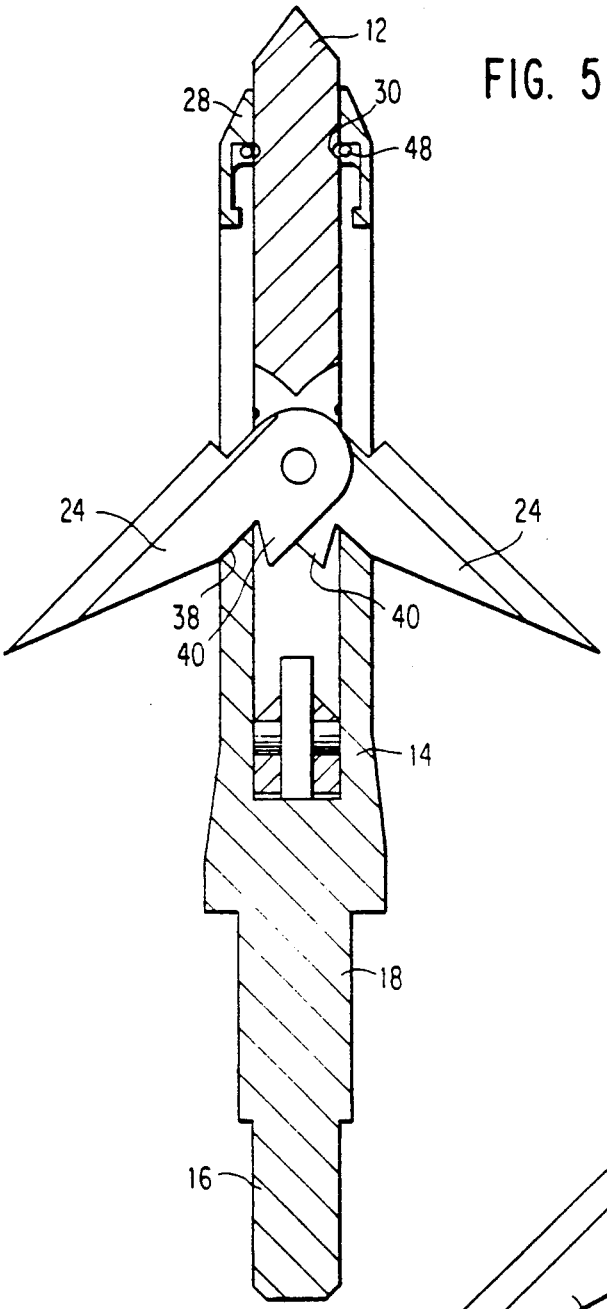
FIG. 5 is a cross-sectional side view of a broadhead in the impact configuration showing the upper pair of blades in their open position.
Figure 6:
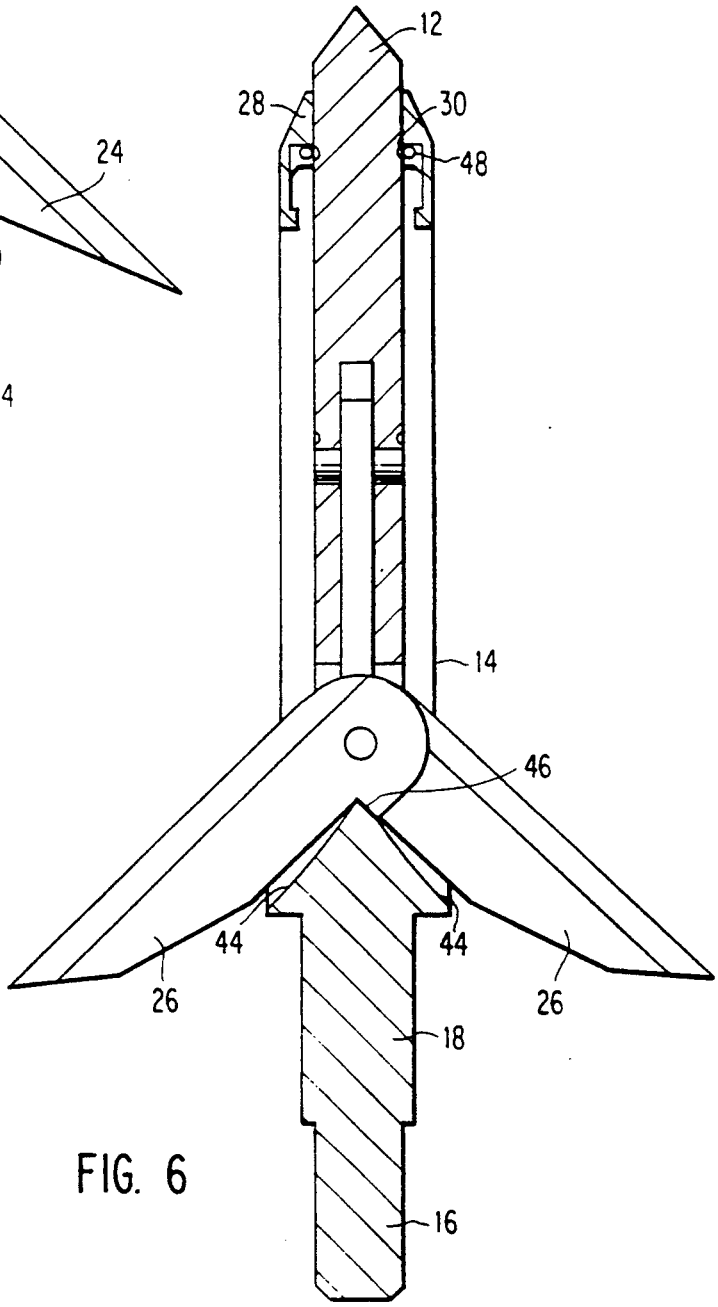
FIG. 6 is a cross-sectional side view of the broadhead shown in FIG. 5 taken 90° therefrom showing the lower pair of blades in their open position.
Figure 7:
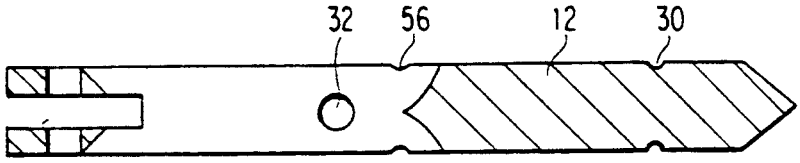
FIG. 7 is a cross-sectional side view of a plunger tip showing the pin position of the upper pair of blades.
Figure 8:
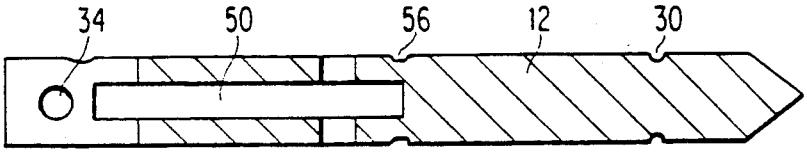
FIG. 8 is a cross-sectional side view of the plunger tip shown in FIG. 7 taken 90° therefrom showing the pin position of the lower pair of blades.

Referring now to FIGS. 5 and 6, which show two cross-sectional views taken at 90° increments with respect to one another of a broadhead 10 in its "impact" configuration, the upper blades 24 are held by notches 40 in the area behind cam surface 38 and the lower blades 26 are held by notches 46 against opposite sides of cam surface 44. The C-shaped ring 48 positively locks the blades 24 and 26 in their open positions.

While the invention has been described in terms of its preferred embodiment where two pairs of cutting blades are positioned on pivot pins connected to a front plunger tip at different heights and are spaced at 90° increments about the cylindrical body, those skilled in the art will recognize that the number of blades and their placement relative to the cylindrical body can be varied within the spirit and scope of the appended claims.

Having thus described my invention what I intend to secure by Letters Patent is the following:

1. A broadhead, comprising:

a body attachable to an arrow shaft, said body being immoveable relative to an arrow shaft once said body is attached to an arrow shaft;

a plunger slidable in a bore in said body;

means for alternatively holding said plunger in a first or second position relative to said body;

two pairs of cutting blades connected by pivot pins to said plunger, a first pair of cutting blades connected at a first location on said plunger, a second pair of cutting blades connected at a second location on said plunger;

means for holding said cutting blades in a retracted position close to said body when said plunger is in said first position; and cam surfaces on said body positioned to open said first and second pairs of cutting blades as said plunger moves from said first position to said second position.

2. The broadhead recited in claim 1 wherein said plunger has a pair of channels formed at third and fourth locations axially spaced on said plunger and said means for alternatively holding said plunger in said first and second positions comprises a ring having a first internal perimeter sized to fit in said channels at said third and fourth locations, said ring being capable of opening to have a second internal perimeter large enough to allow said plunger to slide therethrough.

3. A broadhead, comprising:

a body attachable to an arrow shaft, said body being immovable relative to an arrow shaft once said body is attached to an arrow shaft;

a plunger slidable in a bore in said body having a pointed end which projects out of said body from said bore in said body, said plunger being slidable between a first position and a second position relative to said body wherein said pointed end of said plunger is furthest from said body when said plunger is in said first position and wherein said pointed end of said plunger is closest to said body when said plunger is in said second position;

a cutting blade mounted on a pivot pin connected to said plunger, said cutting blade having a pivoting end which pivots on said pivot pin and an opening end which opens away from said body;

a means for holding said cutting blade in a retracted position wherein said pivoting end of said cutting blade is closer to said pointed end of said plunger than said opening end of said cutting blade and wherein said opening end of said cutting blade is held at a first point close to said body; and a cam surface on said body positioned to open said opening end of said cutting blade to a second point away from said body as said plunger moves from said first position to said second position.

4. A broadhead, comprising:

a body attachable to an arrow shaft, said body being immovable relative to an arrow shaft once said body is attached to an arrow shaft;

a plunger slidable in a bore in said body having a pointed end which projects out of said body from said bore in said body, said plunger being slidable between a first position and a second position relative to said body wherein said pointed end of said plunger is furthest from said body when said plunger is in said first position and wherein said pointed end of said plunger is closest to said body when said plunger is in said second position;

first and second pairs of cutting blades mounted on first and second pivot pins connected to said plunger at first and second locations, respectively, each of said cutting blades of said first and second pairs of cutting blades having a pivoting end which pivots on said first or second pivot pin and an opening end which opens away from said body;

a means for holding each of said cutting blades in a retracted position wherein said pivoting end of said cutting blade is closer to said pointed end of said plunger than said opening end of said cutting blade and wherein said opening end of each of said cutting blades is held at a first point close to said body; and cam surfaces on said body positioned to open said opening end of each of said cutting blades to a second point away from said body as said plunger moves from said first position to said second position.

5. A broadhead as recited in claim 4 wherein said first location of said first pivot pin is closer to said pointed end of said plunger than said second location of said second pivot pin.

* * * * *